United States Patent [19]

Sermons

[11] 4,089,074

[45] May 16, 1978

[54] LEAF SKIMMER FOR POOLS

[76] Inventor: Charles E. Sermons, Rte. 4, Box 122-A, Pensacola, Fla. 32504

[21] Appl. No.: 738,360

[22] Filed: Nov. 3, 1976

[51] Int. Cl.[2] ..... E04H 3/16; E04H 3/18

[52] U.S. Cl. ..... 4/172

[58] Field of Search ..... 4/172, 172.15, 172.12, 4/172.11, 172.13, 172.14, 172.17; 15/1.7; 43/14; 210/169, 170; 9/310 D

[56] References Cited

U.S. PATENT DOCUMENTS

| | | | |
|---|---|---|---|
| 3,063,077 | 11/1962 | Pansini | 15/1.7 |
| 3,080,590 | 3/1963 | Mullinix et al. | 15/1.7 |
| 3,188,668 | 6/1965 | Buckelew | 15/1.7 |
| 3,579,657 | 5/1971 | Gurrieri | 4/172.12 |
| 3,616,923 | 11/1971 | Haley | 4/172.17 X |
| 3,699,700 | 10/1972 | Kinsell | 43/14 |
| 4,030,148 | 6/1977 | Rosenberg | 4/172 |

*Primary Examiner*—Henry K. Artis

*Attorney, Agent, or Firm*—Clarence A. O'Brien; Harvey B. Jacobson

[57] ABSTRACT

A leaf skimmer for swimming pools has a floating member placeable on the surface of water in the pool adjacent to and upstream of a water circulation drain of the pool. Attached to the floating member is a net immersed in the water for collecting debris in the proximity of the surface of the water in the pool. The floating member is preferably tethered to the side of the pool so as to be easily removable at predetermined intervals for dumping the debris from the net.

5 Claims, 5 Drawing Figures

LEAF SKIMMER FOR POOLS

BACKGROUND OF THE INVENTION

1. Field of the Invention

This invention relates generally to a device for skimming debris from the surface of a body of water, and particularly to a skimmer for swimming and similar pools of water for keeping the surface of the pool free from leaves, twigs, branches, grass, and various other types of debris before the debris has time to settle to the bottom of the pool and making the pool even more difficult to keep clean.

2. Description of the Prior Art

Many bodies of water such as swimming pools require various kinds of debris to be removed from the surface of water in the pool. One known manner of facilitating removal of this debris is to employ a floating device in conjunction with the currents set up by the conventional filtering devices generally provided with swimming pools. These floating devices divert the debris in such a manner as to carry it to the drain of the filtering device. Further, powered devices which employ a rotating screen arrangement have been proposed, and it is also known to use separate pumping arrangements that draws the debris from the pool together with a substantial quantity of water. The latter approaches, however, are rather complex and accordingly rather difficult to use and somewhat costly.

U.S. Pat. No. 3,767,055, issued Oct. 23, 1973 to L. P. Flatland, discloses a skimmer for a water body which floats about the water under power by the action of a propeller driven by a battery energized electric motor. Further, U.S. Pat. No. 3,625,364, issued Dec. 7, 1971 to C. H. LaChance, discloses a skimming device including a screen removably attached to the edge of a swimming pool so as to extend radially into the pool and collect debris brought into the screen by the currents caused by a circulating device associated with the pool. It is also known to manually remove debris from a swimming pool, and the like, by the use of a hand-held raking apparatus as disclosed in U.S. Pat. No. 3,863,237, issued Jan. 28, 1975 to N. N. Doerr.

SUMMARY OF THE INVENTION

It is an object of the present invention to provide a skimming device for swimming and similar pools of water which does not require special attachment of the device to the pool, yet permits the device to be anchored relative to the pool.

It is another object of the present invention to provide a skimmer for swimming and similar pools of water which does not restrict the flow of water in the pool through the device, leaving only the leaves and other debris in the device when same is removed from the water.

It is yet another object of the present invention to provide a skimming device for swimming and similar pools of water wherein the collecting capacity of the device is substantially greater than the collecting capacity of known skimming devices.

It is a still further object of the present invention to provide a skimming device for swimming and similar pools of water which is simple of construction and easy and versatile to use.

These and other objects of the invention are achieved by providing a water surface skimming device having: a floating member for placement on a water surface adjacent to and upstream of a water circulating drain of an associated pool of water; and a screen arrangement attached to the floating member and immersed in the water for collecting debris in the proximity of the surface of the water in the pool.

The float member preferably includes a framework surrounding and defining a hollow interior and comprising a plurality of sides, the screen arrangement being disposed extending beneath the sides of the framework and under the hollow interior. One of the sides of the framework forms an access opening to the hollow interior, with the screen arrangement comprising a net attached to the one of the sides beneath the access opening formed thereby.

The one of the sides of the framework which forms the access opening advantageously comprises a substantially U-shaped member having a back portion and a pair of legs, with the net being attached to the back portion and with the legs engaging sides of the frame joined with the access-opening forming one of the sides of the framework. Float elements attached to the bottom of the framework cause the framework to float at a predetermined level relative to the surface of the water, while the framework is advantageously tethered to the side of a swimming pool, and the like, as by use of a suitable weight.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
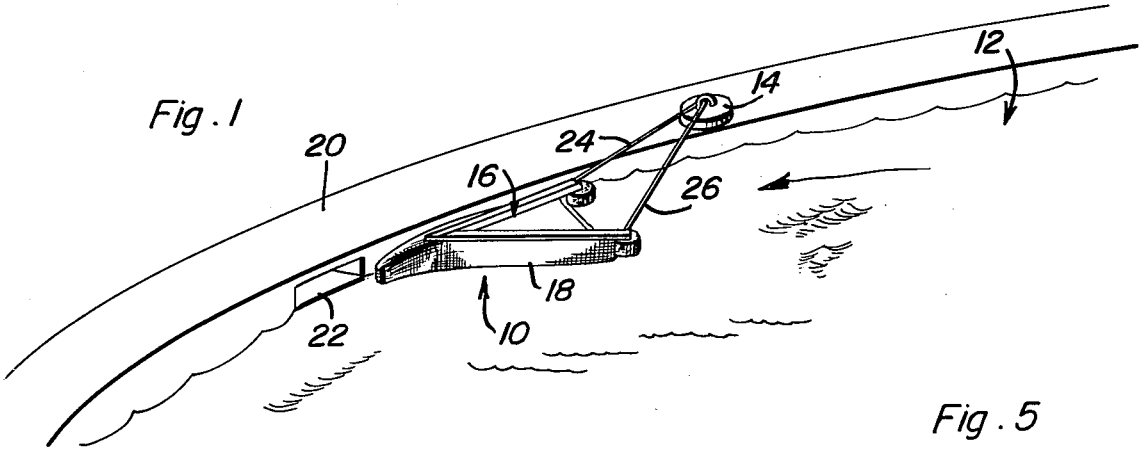
FIG. 1 is a fragmentary, schematic, perspective view showing a skimming device according to the present invention disposed in operative position in a swimming pool.
Figure 5:
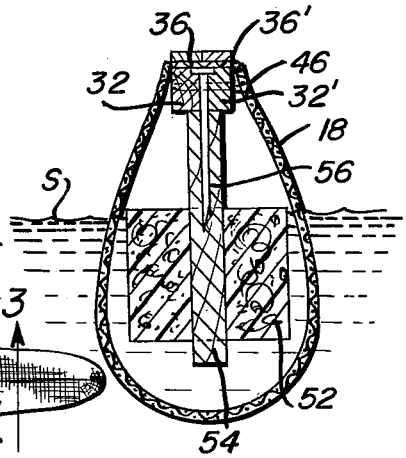
FIG. 5 is an enlarged, sectional view taken generally along the line 5—5 of FIG. 2.
Figure 2:
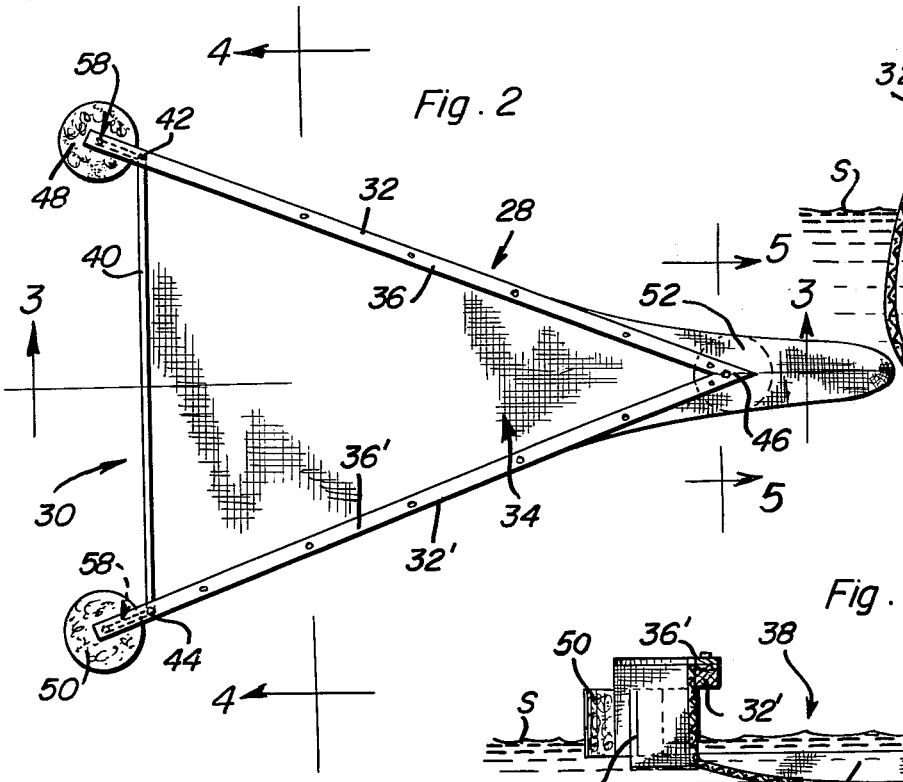
FIG. 2 is a top plan view showing the skimming device of FIG. 1 to a larger scale.
Figure 4:
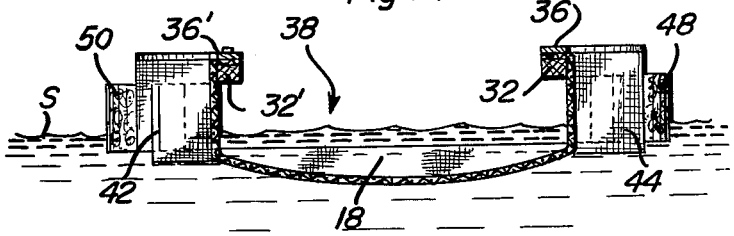
FIG. 4 is a sectional view taken generally along the line 4—4 of FIG. 2, and also showing the skimming device floating on a body of water.
Figure 3:
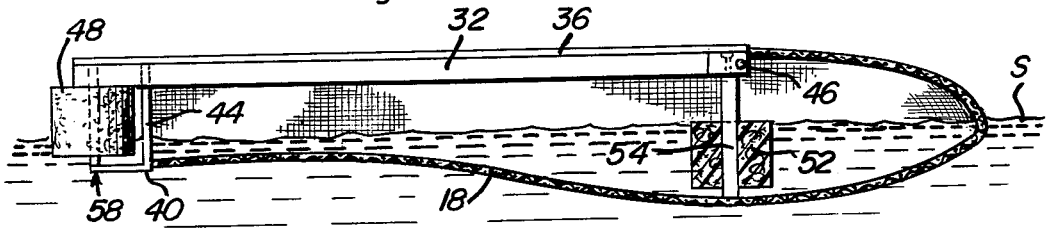
FIG. 3 is a sectional view taken generally along the line 3—3 of FIG. 2, and showing the skimming device floating on a body of water.

Referring now more particularly to FIG. 1 of the drawings, a leaf and other debris skimmer 10 according to the invention is shown disposed in a swimming pool 12 and tethered as by a conventional weight 14. The skimmer 10 comprises a floating member 16 having attached thereto a net 18 which passes beneath the member 16 in order to collect leaves, twigs, branches, grass, and other debris before such debris has time to settle to the bottom (not shown) of pool 12. Floating member 16 is positioned adjacent a boundary of pool 12 in the form of a side portion 20. Further, member 16 is placed adjacent a drain 22 of the filtering system of the pool so as to be in a current indicated by the flow arrow and caused by water entering the pool at a point not shown and being subsequently drained from the pool by passage through drain 22. Member 16 can be tethered to side portion 20 of pool 12 as by the cords 24 and 26 attached to the member 16 and to the weight 14. When full of debris, floating member 16 can be easily removed from pool 12 and the debris dumped from net 18 into an appropriate disposal receptacle (not shown) and the like.

Referring now more particularly to FIGS. 2 through 5 of the drawings, the floating member 16 includes a framework 28 comprising a plurality of sides 30, 32, and 32' surrounding, and forming, a hollow interior 34 of framework 28. Net 18 is disposed extending beneath the sides 30, 32, and 32' of framework 28 and under the hollow interior 34 so as to act as a collecting screen arrangement for skimmer 10. Strips 36 and 36' are mounted on the upper surfaces of the respective sides 32 and 32' as by a plurality of nails, and the like, in order to help retain net 18 on sides 32 and 32' and to cover the raw edges of the net 18.

Side 30 of framework 28 forms an access opening 38 to the hollow interior of framework 28, with net 18 being attached to side 30 beneath the access opening 38 formed by side 30. The latter, which can be fabricated from a length of wire constructed from aluminum or a similar material, comprises a substantially U-shaped member itself forming the access opening 38 and having a bridge portion 40 and a pair of legs 42 and 44 extending codirectionally and substantially perpendicularly from portion 40 at extreme end portions of the portion 40. Net 18 is attached to portion 40 in a suitable manner, while legs 42 and 44 engage in apertures appropriately provided in the adjacent ends of sides 32 and 32' of framework 28 for joining sides 32 and 32' to side 30. Sides 32 and 32' extend from side 30 so as to merge toward and join one another in order to form a wedge. A suitable nail 46, and the like, can be employed in order to pin sides 32 and 32' together at the beveled ends thereof spaced from the ends connected to side 30.

Three annular float elements 48, 50, and 52, which may be constructed in any conventional manner from a foamed polymeric material, and the like, assure that framework 28 will float on the body of water in pool 12 in a specific relationship with respect to the surface S of the water, are provided. Floats 48 and 50 are arranged on the legs 42 and 44 of the U-shaped member forming side 30 of the framework 28, and float 52 is mounted on a pin 54 which is itself mounted where the sides 32 and 32' join one another. Net 18 is disposed surrounding float 52 as perhaps can best be seen from FIG. 3. The pin 54 is attached to sides 32 and 32' at the juncture thereof as by a nail 56, and the like, for supporting the float 52 on framework 28. A suitable cotter pin (not shown), and the like, may be employed to retain float 52 on pin 54.

Floats 48 and 50 may be retained on the ends of the sides 32 and 32' adjacent side 30 by the vertical legs of L-shaped wire brackets extending from the juncture of the portion 40 and legs 42, 44 and inserted in holes suitably provided in the undersurface of sides 32 and 32' adjacent side 30.

As can be appreciated from the above description and from the drawings, a skimmer, according to the present invention, simplifies maintenance of swimming pools, and the like, and eliminates the necessity of a constant arduous and time-consuming task for the pool owner.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A leaf skimmer for swimming and similar pools of water, comprising, in combination:

(a) floating means for placement on a water surface adjacent to and upstream of a water circulating drain of an associated pool; and (b) screen means attached to the floating means and immersed in the water for collecting debris in the proximity of the surface of the water of the pool, the floating means including a framework comprising a plurality of sides surrounding and forming a hollow interior of the framework, the screen means being disposed extending beneath the sides of the framework and under the hollow interior, formed by the framework, the one of the sides of the framework forming an access opening to the hollow interior of the framework, with the screen means comprising a net attached to the one of the sides beneath the access opening formed thereby, and the one of the sides of the framework comprising a substantially U-shaped member having a bridge portion forming the access opening and a pair of legs permitting connection of the U-shaped member to connecting sides of the framework, the net being attached to the bridge portion and the legs being connected to sides of the framework joined with the one of the sides.

2. A structure as defined in claim 1, wherein the sides joined with the one of the sides merge toward and join one another to form a framework in the form of a wedge when viewed in plan.

3. A structure as defined in claim 2, wherein the floating means includes three annular float elements, two of the float elements being arranged adjacent the legs of the U-shaped member and the third of the float elements being mounted on the sides joined with the U-shaped member where these sides join one another, the net being disposed surrounding the third of the float elements.

4. A leaf skimmer for swimming and similar pools of water, comprising, in combination:

(a) floating means for placement on a water surface adjacent to and upstream of a water circulating drain of an associated pool; and (b) screen means attached to the floating means and immersed in the water for collecting debris in the proximity of the surface of the water of the pool, the floating means including a framework comprising a plurality of sides surrounding and forming a hollow interior of the framework, the screen means being disposed extending beneath the sides of the framework and under the hollow interior formed by the framework, with the floating means further including a plurality of float elements arranged on the framework for providing desired duoyancy to the framework, the screen means comprising a net disposed below and generally surrounding the float elements.

5. A structure as defined in claim 4, wherein the sides of the framework form a substantially triangular-shaped wedge when viewed in plan, with one of the sides of the framework forming an access opening to the hollow interior formed by the framework.

* * * * *